US012133597B2

(12) United States Patent
Teo et al.

(10) Patent No.: US 12,133,597 B2
(45) Date of Patent: Nov. 5, 2024

(54) DETACHABLE JEWELRY ORGANIZER DEVICE

(71) Applicants: Su Ying Teo, Paramus, NJ (US); Caylee Kong, Paramus, NJ (US)

(72) Inventors: Su Ying Teo, Paramus, NJ (US); Caylee Kong, Paramus, NJ (US)

( * ) Notice: Subject to any disclaimer, the term of this patent is extended or adjusted under 35 U.S.C. 154(b) by 0 days.

(21) Appl. No.: 18/329,164

(22) Filed: Jun. 5, 2023

(65) Prior Publication Data

US 2024/0251969 A1 Aug. 1, 2024

Related U.S. Application Data

(60) Provisional application No. 63/442,538, filed on Feb. 1, 2023.

(51) Int. Cl.
*A47F 7/02* (2006.01)
*A47F 7/03* (2006.01)

(52) U.S. Cl.
CPC ..... *A47F 7/022* (2013.01); *A47F 7/03* (2013.01); *Y10S 211/01* (2013.01)

(58) Field of Classification Search
CPC .... A47F 7/02; A47F 7/022; A47F 7/03; Y10S 211/01
USPC ..... 211/85.2, DIG. 1, 44, 45, 128.1; 206/6.1
See application file for complete search history.

(56) References Cited

U.S. PATENT DOCUMENTS 740,001 A * 9/1903 Flanagin ..... A47K 10/38 206/748
1,997,490 A * 4/1935 Hoar ..... A47B 61/003 211/124
2,951,589 A * 9/1960 Dudley ..... A47F 7/12 211/59.1
2,962,156 A * 11/1960 Adams ..... A45C 11/16 206/559
3,421,634 A * 1/1969 Huth ..... A47B 81/00 211/85.2
4,390,099 A * 6/1983 Trautlein ..... A47F 7/02 211/85.2
D270,220 S * 8/1983 Cuminale ..... D6/682.4
4,446,974 A * 5/1984 Ott ..... A47F 7/163 211/45
4,771,206 A * 9/1988 Taylor ..... A47F 7/03 312/305
4,854,456 A * 8/1989 Lee ..... A47B 81/007 211/175
4,978,001 A * 12/1990 Nelson ..... A47B 46/00 248/222.52
5,427,230 A 6/1995 Mattox (Continued)

*Primary Examiner* — Jennifer E. Novosad
(74) *Attorney, Agent, or Firm* — Brennan, Manna & Diamond, LLC

(57) ABSTRACT

A jewelry organizer device is disclosed that can function vertically or horizontally. The device comprises a base component with a recessed drawer and a plurality of cylinders that receive scrunchies, necklaces, bracelets, and other jewelry. Each cylinder includes magnetic sections that allow the cylinders to be pulled apart at various points along the cylinder and secured back together. When pulled apart, the cylinders allow the jewelry to be removed from the device without having to remove all the jewelry beside it. Instead, users can separate the magnetic cylinders by detaching the magnets and pulling off the desired jewelry piece, before repositioning the magnetic cylinders back together.

15 Claims, 3 Drawing Sheets

(56) References Cited

U.S. PATENT DOCUMENTS 5,449,073 A * 9/1995 DeBeverly ..... A47F 7/00 211/85.2
5,584,404 A * 12/1996 Tsai ..... A47K 10/08 108/29
6,158,578 A * 12/2000 Greiner ..... A47F 5/10 211/85.2
D473,731 S * 4/2003 Banks ..... D6/672
6,789,668 B2 * 9/2004 Kuo ..... G11B 23/00 211/41.12
D532,994 S * 12/2006 Rice ..... D6/682.6
7,806,284 B2 10/2010 Mangano
7,878,333 B1 * 2/2011 Necessary ..... A47F 7/03 206/747
8,141,721 B2 * 3/2012 Harris-Bowman .... A45C 11/16 211/85.2
8,651,291 B1 * 2/2014 Prather ..... A45F 5/00 211/85.2
8,800,789 B2 * 8/2014 Sharp ..... A47F 7/02 211/85.2
9,420,860 B2 * 8/2016 Jaffe ..... A47F 5/02
9,596,949 B1 * 3/2017 Scampoli ..... A47F 7/12
9,693,643 B1 * 7/2017 Laskowitz ..... A47F 7/024
9,723,904 B1 8/2017 Taylor
9,763,529 B2 * 9/2017 Abebe ..... A47G 29/08
10,010,196 B2 * 7/2018 Millen ..... A47F 7/02
10,206,523 B2 * 2/2019 Abebe ..... F16B 7/22
10,898,013 B2 * 1/2021 Kempner ..... A47F 7/02
2004/0060879 A1 * 4/2004 Cohen ..... A47F 7/022 211/85.2
2005/0194334 A1 * 9/2005 Johnson ..... A45D 8/36 211/85.2
2007/0167202 A1 * 7/2007 Belzile ..... A47G 1/12 463/4
2009/0026158 A1 1/2009 Mangano
2009/0057166 A1 * 3/2009 Nelson ..... A47G 25/14 206/6.1
2009/0184073 A1 * 7/2009 Lu ..... A47G 25/0664 211/198
2011/0215063 A1 * 9/2011 Wolpert ..... A45C 11/16 211/85.2
2012/0125046 A1 5/2012 Vander Wal
2015/0313379 A1 * 11/2015 Millen ..... A47F 5/0006 211/85.2
2023/0404228 A1 * 12/2023 Holland ..... A47B 67/02
2024/0016317 A1 * 1/2024 Darsan ..... A47F 5/01

* cited by examiner

DETACHABLE JEWELRY ORGANIZER DEVICE

CROSS-REFERENCE TO RELATED APPLICATION

The present application claims priority to, and the benefit of, U.S. Provisional Application No. 63/442,538, which was filed on Feb. 1, 2023, and is incorporated herein by reference in its entirety.

FIELD OF THE INVENTION

The present invention relates generally to the field of jewelry organizer devices. More specifically, the present invention relates to a detachable jewelry organizer that can be separated to access the bottom, middle, and any other section of the holder. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in jewelry organizer devices. Generally, people may have several jewelry items like watches, bracelets, necklaces, etc., that are stored on jewelry holders or in drawers. However, items stored on a jewelry holder can be difficult to access if a person needs to remove an accessory from the base or side of the holder. Thus, items above or next to the desired accessory must be removed first before accessing the desired one. Further, taking everything off the holder to reach the desired accessory can be frustrating. Accordingly, people may just end up tossing extra jewelry in a drawer or cabinet and risk damage and disorganization.

Generally, home jewelry storage devices of the art typically include drawers or bins in which to place pieces of jewelry. However, jewelry owners may have sizable quantities of various types of jewelry, but due to streamlining the dressing process, tend to wear the same pieces to avoid the time it takes to look over the collection and select different pieces each day. Also troublesome, is picking through and accessing jewelry pieces. Many storage organizing devices require removal of the jewelry next to or beside, to remove the intended jewelry piece from the organizer, and such manipulation can be difficult. A further drawback of many jewelry holders is that physical access to one jewelry piece for removal from the organizer device causes large amounts of jewelry to be jostled and possibly knocked off. Similarly, an organizer with many different jewelry pieces can be cluttered and jewelry pieces can interfere with one another when being stored.

Accordingly, a need remains for a jewelry organizer device that can function vertically or horizontally and that features multiple cylinders with magnets, allowing sections to be removed when removing jewelry from the device. Further, separating the cylinders by detaching the magnets allows a user to easily pull off the desired jewelry piece with ease, without having to remove adjacent jewelry pieces.

Therefore, there exists a long-felt need in the art for a jewelry organizer device that provides users with a detachable jewelry organizer that can be separated to access the bottom, middle, and any other section of the holder. There is also a long-felt need in the art for a jewelry organizer device that features magnetic connections that can be secured or detached to access the different areas without having to remove other jewelry to obtain a desired accessory. Further, there is a long-felt need in the art for a jewelry organizer device that allows users to secure scrunchies, bracelets, necklaces, watches, and other desired jewelry pieces to the holder for easy access. Moreover, there is a long-felt need in the art for a device that includes a drawer at the base to store additional jewelry like rings or earrings. Further, there is a long-felt need in the art for a jewelry organizer device that functions as a vertical or a horizontal tiered stand covered in velvet to prevent any damage to the jewelry while it is stored. Finally, there is a long-felt need in the art for a jewelry organizer device that provides an enhanced jewelry storage experience for both males and females.

The subject matter disclosed and claimed herein, in one embodiment thereof, comprises a jewelry organizer device. The device is an improved jewelry holding system that can function vertically or horizontally. The device comprises a base component with a recessed drawer and a plurality of cylinders that receive scrunchies, necklaces, bracelets, and other jewelry. Each cylinder includes magnetic sections that allows the cylinders to be pulled apart at various points along the cylinder and secured back together. When pulled apart, the cylinders allow the scrunchies, bracelets, watches, and other jewelry to be removed from the device without having to remove all the jewelry itself. Instead, users can separate the magnetic cylinders by detaching the magnets and pulling off the desired jewelry piece, before repositioning the magnetic cylinders back together.

Further, the base component or stand can be covered in velvet to prevent damage to the jewelry when stored. The base component can be constructed using acrylic, wood, or metal materials. In a vertical configuration, the base component can comprise cylinders attached to the top of the base component that can be separated, as desired. In a horizontal configuration, the base component secures multiple cylinders in a tiered configuration, for securing jewelry thereto. Thus, users can safely store their jewelry while staying organized.

In this manner, the jewelry organizer device of the present invention accomplishes all of the foregoing objectives and provides users with a device that can be separated to access individual jewelry pieces. The device features magnetic connections to secure and detach the cylinders for jewelry storage. The device can be manufactured of acrylic, wood, or metal materials.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a jewelry organizer device. The device is an improved jewelry holding system that can function vertically or horizontally. The device comprises a base component with a recessed drawer and a plurality of cylinders that receives scrunchies, necklaces, bracelets, and other jewelry. Each cylinder includes magnetic sections that allow the cylinders to be pulled apart at various points along the cylinder and secured back together. When pulled apart, the cylinders allow the scrunchies, bracelets, watches, and other jewelry to be removed from the device without having to remove all the jewelry itself. Instead, users can separate the magnetic cylinders by detaching the magnets and pulling off the desired jewelry piece, before repositioning the magnetic cylinders back together. Thus, users can safely store their jewelry while staying organized.

The primary objective of the present invention is a device for storage and ease of access for multiple pieces of jewelry. Thus, the jewelry organizer device provides for the display and storage of multiple pieces of jewelry and allows such jewelry to be easily accessible and easily retrieved from the organizer device. Typical jewelry contemplated for use with the organizer device according to the present invention includes, but is not limited to, bracelets, necklaces, earrings, watches, bangles, scrunchies, etc., or any other suitable jewelry as is known in the art.

In one embodiment, the jewelry organizer device comprises a base component, which is a circular or rectangular shaped base that retains the plurality of cylinders in a horizontal or vertical configuration, but can be any other suitable shape as is known in the art. The base component can be any suitable shape and size as is known in the art, as long as it can retain the plurality of cylinders in a vertical or a horizontal configuration. Generally, the base component comprises a top and a bottom surface and opposing sides.

In one embodiment, in the vertical configuration, at least one cylinder is secured in a vertical position in approximately the middle of the base component. In other embodiments, more than one cylinder can be secured in vertical positions on the base component, depending on the needs and/or wants of a user. The cylinders can be secured via magnets, adhesive, glue, screws, pins, etc., or any other suitable securing means as is known in the art. The cylinders used in the vertical configuration are sized to retain rings or other small jewelry. Thus, the diameter of these cylinders is small. However, the cylinders used in the vertical configuration can also comprise a diameter that is large enough to secure a bracelet or watch, or other suitable sized jewelry.

In one embodiment, in the horizontal configuration, at least one cylinder is secured in a horizontal position, in approximately the middle of the base component. In other embodiments, more than one cylinder is secured in a horizontal position, typically in a tiered position on the base component, depending on the needs and/or wants of a user. The cylinders can be secured via plastic brackets, rods and pins, etc., or any other suitable securing means as is known in the art. Generally, the cylinders float above or are suspended above the base component via the plastic brackets or other securing means. Further, the cylinders used in the horizontal configuration typically comprise a diameter that is large enough to secure bracelets, watches, or necklaces.

In either configuration, vertical or horizontal, the jewelry organizer device contemplates an embodiment having a variety of cylinders arranged in varying heights on the base component. The varying heights provide varying jewelry display heights to enable ease of viewing and retrieval, especially of longer lengths of necklaces or bracelets. Also contemplated is having varying jewelry display heights for aesthetic appeal.

In one embodiment, the plurality of cylinders are cylindrical in shape and can be any suitable length as is known in the art, depending on the wants and/or needs of a user. The cylinders are broken into segments and secured together magnetically allowing a user to pull apart and reposition the magnetic segments, as needed. The cylinders can be broken into any suitable number of magnetic segments as is known in the art depending on the needs and/or wants of a user. The magnetic segments can be any suitable length as is known in the art. In some embodiments, the magnetic segments are all the same length. In other embodiments, the magnetic segments are different lengths and can be arranged in various configurations.

In one embodiment, the base component comprises a recessed drawer for storing additional jewelry, such as rings and earrings, and other small jewelry pieces, etc. The drawer slides into the base component and can be any suitable shape and size as is known in the art. Once inserted into the base component, the drawer is flush with or recessed within the base component, so as not to protrude from the base component. The drawer can have inserts, divisions, slots, tabs, etc., or any other suitable means for retaining and storing the jewelry within.

In one embodiment, the base component and the plurality of cylinders are covered in velvet or other suitable material, to prevent damage to the jewelry stored on the device and within the drawer.

In one embodiment, the detachable magnetic segments of the cylinders on the device maintain ease of accessibility to the jewelry stored on the device, specifically in the taking off and putting on of the jewelry. Further, the detachable magnetic segments of the cylinders prevent the base component from interfering with easy access to the jewelry stored on the device.

In one embodiment, the plurality of cylinders are magnetic and configured into magnetic segments that can be separated and repositioned back together, as needed. Specifically, the magnetic segments contain a ferromagnetic (i.e., such as iron or steel) and/or magnetic element at each of their corresponding ends. The position of the magnetic and/or ferromagnetic element in the cylinder segments is preferably such that the magnetic force between the magnetic elements and the ferromagnetic elements of the segment ends provide secure removable attachment of the cylinder segments. In one embodiment, the magnetic and/or ferromagnetic elements are housed within the cylinder segments, such that they are not visible when the cylinder segments are secured together. In another embodiment, instead of magnetic elements, the cylinder segments utilize hook and loop type fasteners to allow for removal and repositioning when needed.

Accordingly, the magnetic and/or ferromagnetic elements of the cylinder segments allow the cylinders to be pulled apart at various points along the cylinder and secured back together. When pulled apart, the cylinders allow the jewelry (i.e., scrunchies, bracelets, watches, and other jewelry) to be removed from the device without having to remove all the jewelry itself. Instead, users can separate the magnetic cylinders by detaching the magnets and pulling off the desired jewelry piece, before repositioning the magnetic cylinders back together.

In one embodiment, the jewelry organizer device can be manufactured of acrylic, wood, or metal materials, etc., or any other suitable materials as is known in the art.

In yet another embodiment, the jewelry organizer device comprises a plurality of indicia.

In yet another embodiment, a method of organizing and protecting jewelry is disclosed. The method includes the steps of providing a jewelry organizer device comprising a base component with a plurality of cylinders that receive jewelry. The method also comprises utilizing the jewelry organizer device in a vertical or a horizontal configuration. Further, the method comprises securing a plurality of jewelry to the plurality of cylinders. The method also comprises detaching specific magnetic sections from the cylinders and pulling off a desired jewelry piece. Finally, the method comprises repositioning the magnetic sections back together.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1A:
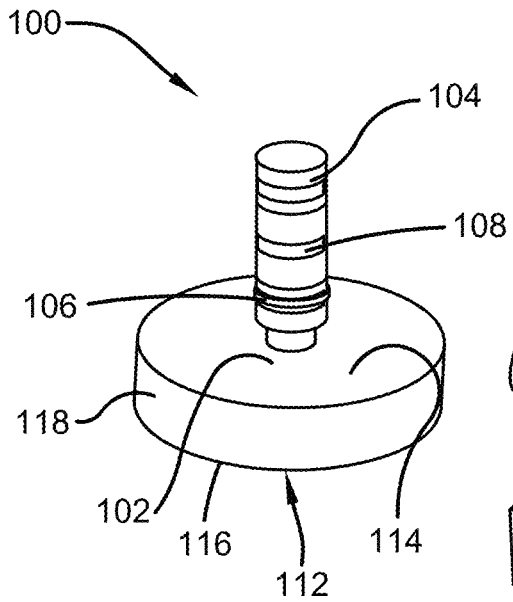
FIG. 1A illustrates a front perspective view of one embodiment of the jewelry organizer device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a jewelry organizer device that provides users with a detachable jewelry organizer that can be separated to access the bottom, middle, and any other section of the holder. There is also a long-felt need in the art for a jewelry organizer device that features magnetic connections that can be secured or detached to access the different areas, without having to remove other jewelry to obtain a desired accessory. Further, there is a long-felt need in the art for a jewelry organizer device that allows users to secure scrunchies, bracelets, necklaces, watches, and other desired jewelry pieces to the holder for easy access. Moreover, there is a long-felt need in the art for a device that includes a drawer at the base to store additional jewelry like rings or earrings. Further, there is a long-felt need in the art for a jewelry organizer device that functions as a vertical or a horizontal tiered stand covered in velvet to prevent any damage to the jewelry while it is stored. Finally, there is a long-felt need in the art for a jewelry organizer device that provides an enhanced jewelry storage experience for both males and females.

The present invention, in one exemplary embodiment, is a novel jewelry organizer device. The device is an improved jewelry holding system that can function vertically or horizontally. The device comprises a base component with a recessed drawer and a plurality of cylinders that receive scrunchies, necklaces, bracelets, and other jewelry. Each cylinder includes magnetic sections that allow the cylinders to be pulled apart at various points along the cylinder and secured back together. Users can separate the magnetic cylinders by detaching the magnets and pulling off the desired jewelry piece, before repositioning the magnetic cylinders back together. The present invention also includes a novel method of organizing and protecting jewelry. The method includes the steps of providing a jewelry organizer device comprising a base component with a plurality of cylinders that receive jewelry. The method also comprises utilizing the jewelry organizer device in a vertical or a horizontal configuration. Further, the method comprises securing a plurality of jewelry to the plurality of cylinders. The method also comprises detaching specific magnetic sections from the cylinders and pulling off a desired jewelry piece. Finally, the method comprises repositioning the magnetic sections back together.

Figure 1B:
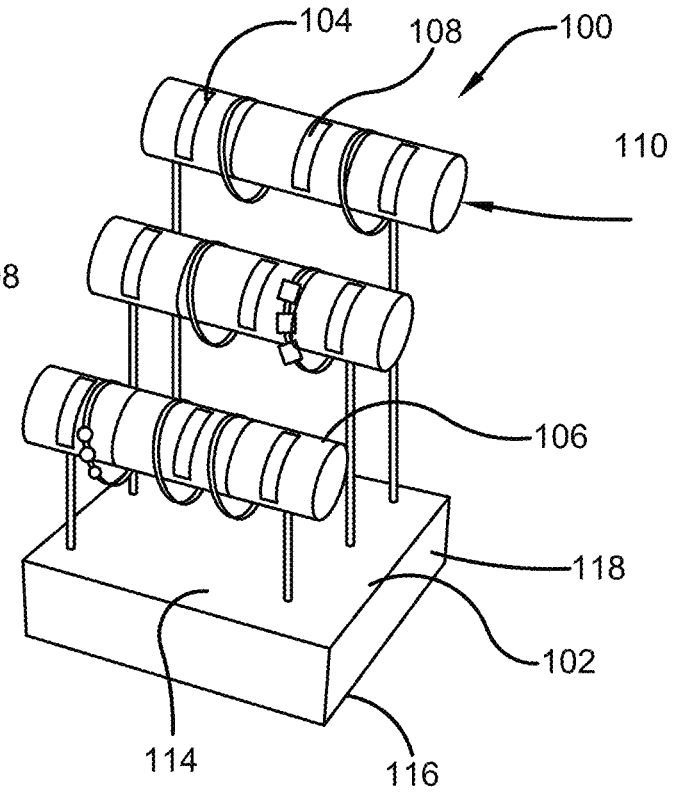
FIG. 1B illustrates a front perspective view of another embodiment of the jewelry organizer device of the present invention in accordance with the disclosed architecture.

Referring initially to the drawings, FIGS. 1A and 1B illustrate perspective views of different embodiments of the jewelry organizer device 100 of the present invention. In the present embodiment, the jewelry organizer device 100 is an improved jewelry organizer device 100 that provides users with a detachable jewelry organizer that can be separated to access the jewelry pieces 106. The jewelry organizer device 100 can function vertically or horizontally. Specifically, the jewelry organizer device 100 comprises a base component 102 with a plurality of cylinders 104 for storing and securing jewelry pieces 106. Each cylinder 104 includes magnetic sections 108 that allow the cylinders 104 to be pulled apart at various points along the cylinder 104 and secured back together. Accordingly, users can separate the magnetic cylinders 104 by detaching the magnets 108 and pulling off the desired jewelry piece 106, before repositioning the magnetic cylinders 104 back together. Thus, users can safely store their jewelry 106 while staying organized.

Accordingly, the primary objective of the present invention is a device 100 for storage and ease of access for multiple pieces of jewelry 106. Thus, the jewelry organizer device 100 provides for the display and storage of multiple pieces of jewelry 106 and allows such jewelry 106 to be easily accessible and easily retrieved from the organizer device 100. Typical jewelry 106 contemplated for use with the organizer device 100 according to the present invention includes, but is not limited to, bracelets, necklaces, earrings, watches, bangles, scrunchies, etc., or any other suitable jewelry 106, as is known in the art depending on the needs and/or wants of a user.

Generally, the jewelry organizer device 100 comprises a base component 102, which is a circular or rectangular shaped base that retains the plurality of cylinders 104 in a horizontal 110 or vertical 112 configuration, but can be any other suitable shape as is known in the art. The base component 102 can be any suitable shape and size as is known in the art, as long as it can retain the plurality of cylinders 104 in a vertical 112 or horizontal 110 configuration. Generally, the base component 102 comprises a top 114 and a bottom 116 surface and opposing sides 118.

Figure 2:
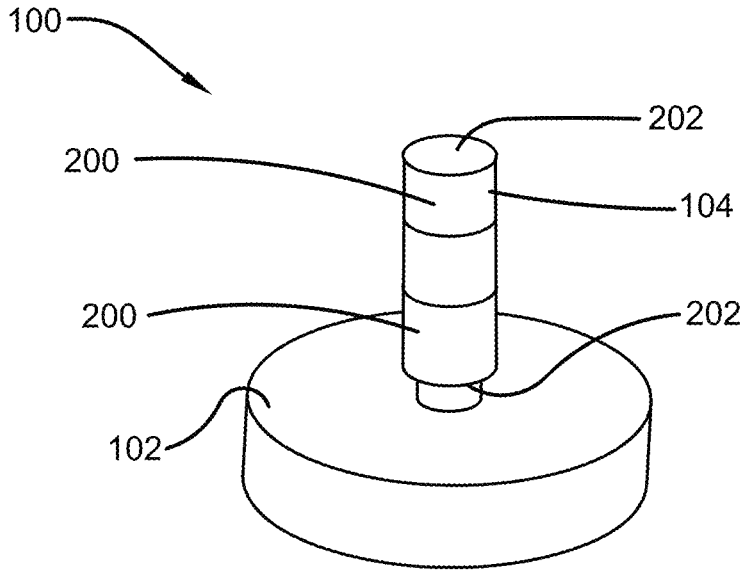
FIG. 2 illustrates a front perspective view of one embodiment of the jewelry organizer device of the present invention showing the magnetic properties in accordance with the disclosed architecture.

As shown in FIG. 2, the plurality of cylinders 104 are cylindrical in shape and can be any suitable length as is known in the art, depending on the wants and/or needs of a user. The cylinders 104 are broken into segments 200 and secured together magnetically allowing a user to pull apart and reposition the magnetic segments 200, as needed. The cylinders 104 can be broken into any suitable number of magnetic segments 200 as is known in the art depending on the needs and/or wants of a user. The magnetic segments 200 can be any suitable length as is known in the art. In some embodiments, the magnetic segments 200 are all the same length. In other embodiments, the magnetic segments 200 are different lengths and can be arranged in various configurations.

Typically, the detachable magnetic segments 200 of the cylinders 104 on the device 100 maintain ease of accessibility to the jewelry 106 stored on the device 100, specifically in the taking off and putting on of the jewelry 106. Further, the detachable magnetic segments 200 of the cylinders 104 prevent the base component 102 from interfering with easy access to the jewelry 106 stored on the device 100.

In one embodiment, the plurality of cylinders 104 are magnetic 108 and configured into magnetic segments 200 that can be separated and repositioned back together, as needed. Specifically, the magnetic segments 200 contain a ferromagnetic (i.e., such as iron or steel) and/or magnetic element 108 at each of their corresponding ends 202. The position of the magnetic and/or ferromagnetic element 108 in the cylinder 104 segments 200 is preferably such that the magnetic force between the magnetic elements 108 and the ferromagnetic elements of the segment 200 ends 202 provide secure removable attachment of the cylinder 104 segments 200. In one embodiment, the magnetic and/or ferromagnetic elements 108 are housed within the cylinder 104 segments 200, such that they are not visible when the cylinder 104 segments 200 are secured together. In another embodiment, instead of magnetic elements 108, the cylinder 104 segments 200 utilize hook and loop type fasteners (not shown) to allow for removal and repositioning when needed.

Accordingly, the magnetic and/or ferromagnetic elements 108 of the cylinder 104 segments 200, allow the cylinders 104 to be pulled apart at various points along the cylinder 104 and secured back together. When pulled apart, the cylinders 104 allow the jewelry 106 (i.e., scrunchies, bracelets, watches, and other jewelry) to be removed from the device 100 without having to remove all the jewelry 106 itself. Instead, users can separate the magnetic cylinders 104 by detaching the magnets and pulling off the desired jewelry piece 106, before repositioning the magnetic cylinders 104 back together.

Figure 3:
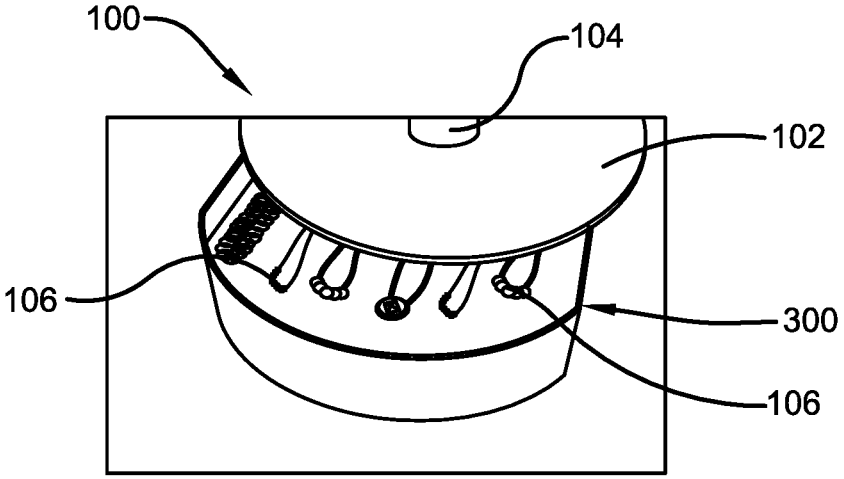
FIG. 3 illustrates a front perspective view of one embodiment of the jewelry organizer device of the present invention showing the recessed drawer in accordance with the disclosed architecture.

As shown in FIG. 3, the base component 102 comprises a recessed drawer 300 for storing additional jewelry 106, such as rings and earrings, and other small jewelry pieces, etc. The drawer 300 slides into the base component 102 and can be any suitable shape and size as is known in the art. Once inserted into the base component 102, the drawer 300 is flush with or recessed within the base component 102, so as not to protrude from the base component 102. The drawer 300 can have inserts, divisions, slots, tabs, etc., or any other suitable means for retaining and storing the jewelry 106 within.

Figure 4:
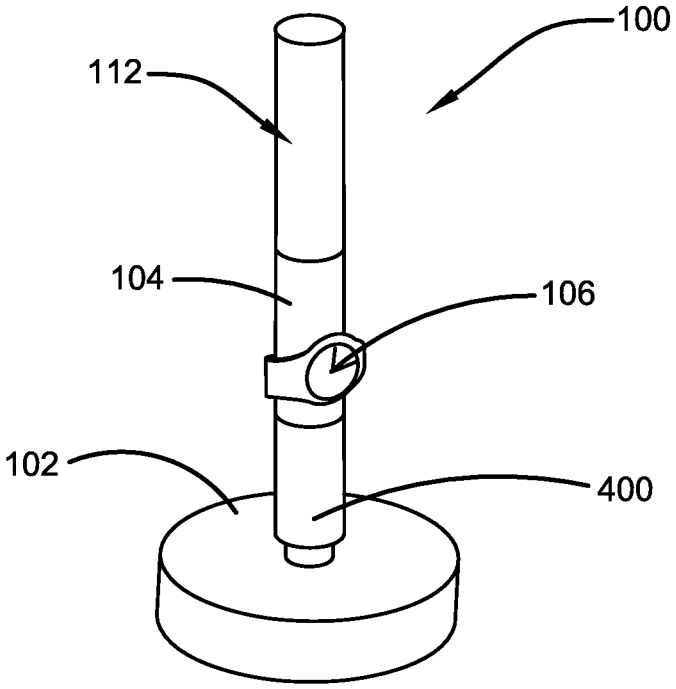
FIG. 4 illustrates a front perspective view of one embodiment of the jewelry organizer device of the present invention showing the vertical configuration in accordance with the disclosed architecture.

As shown in FIG. 4, in the vertical configuration 112, at least one cylinder 104 is secured in a vertical position in approximately the middle 400 of the base component 102. In other embodiments, more than one cylinder 104 can be secured in vertical positions on the base component 102, depending on the needs and/or wants of a user. The cylinders 104 can be secured via magnets, adhesive, glue, screws, pins, etc., or any other suitable securing means as is known in the art. The cylinders 104 used in the vertical configuration 112 are sized to retain rings or other small jewelry 106. Thus, the diameter of these cylinders 104 is small. However, the cylinders 104 used in the vertical configuration 112 can also comprise a diameter that is large enough to secure a bracelet or watch, or other suitable sized jewelry 106.

Figure 5:
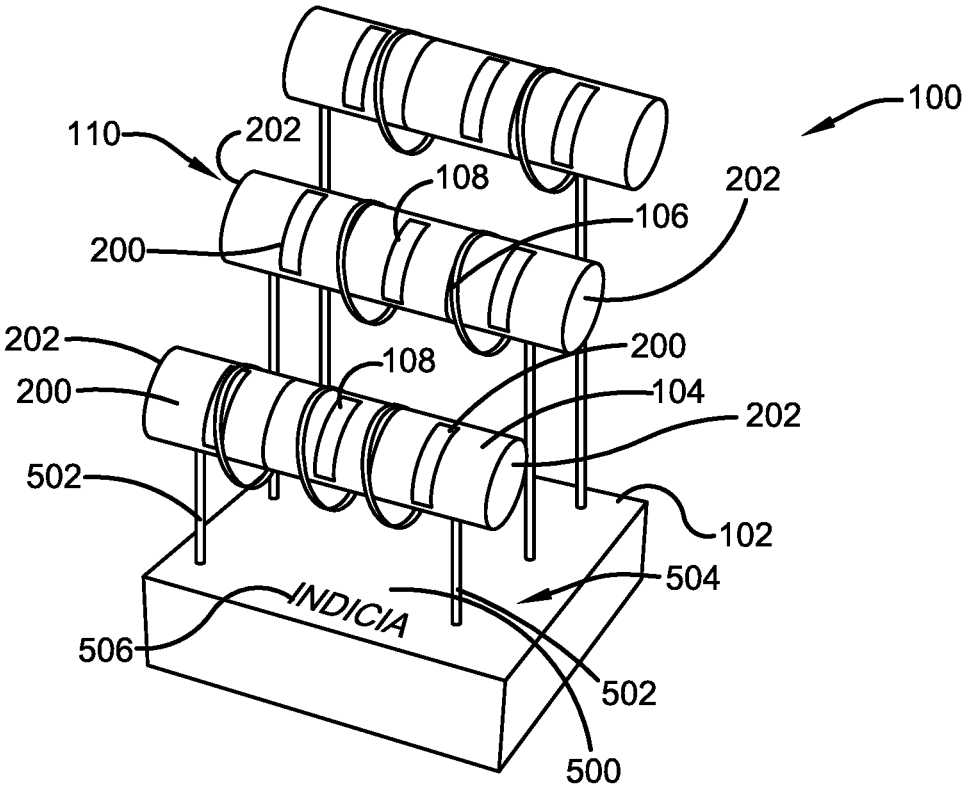
FIG. 5 illustrates a front perspective view of one embodiment of the jewelry organizer device of the present invention showing the horizontal configuration in accordance with the disclosed architecture.

As shown in FIG. 5, in the horizontal configuration 110, at least one cylinder 104 is secured in a horizontal position in approximately the middle 500 of the base component 102. In other embodiments, more than one cylinder 104 is secured in a horizontal position, typically in a tiered position on the base component 102, depending on the needs and/or wants of a user. The cylinders 104 can be secured via plastic brackets 502, rods and pins, etc., or any other suitable securing means as is known in the art. Generally, the cylinders 104 float above or are suspended above the base component 102 via the plastic brackets 502 or other securing means. Further, the cylinders 104 used in the horizontal configuration typically comprise a diameter that is large enough to secure bracelets, watches, or necklaces, etc.

In either configuration, vertical 112 or horizontal 110, the jewelry organizer device 100 contemplates an embodiment having a variety of cylinders 104 arranged in varying heights on the base component 102. The varying heights provide varying jewelry display heights to enable ease of viewing and retrieval, especially of longer lengths of necklaces or bracelets. Also contemplated is having varying jewelry display heights for aesthetic appeal.

In one embodiment, the base component 102 and the plurality of cylinders 104 are covered in velvet 504 or other suitable soft material to prevent damage to the jewelry 106 stored on the device 100 and within the drawer 300. Any suitable soft material can be utilized as is known in the art, depending on the needs and/or wants of a user, as well as the type of jewelry 106 being displayed on the device 100.

In another embodiment, the jewelry organizer device 100 can be manufactured of acrylic, wood, or metal materials, etc., or any other suitable materials as is known in the art, depending on the needs and/or wants of a user.

In yet another embodiment, the jewelry organizer device 100 comprises a plurality of indicia 506. The base component 102 of the device 100 may include advertising, trademark, other letters, designs, or characters, printed, painted, stamped, or integrated into the base component 102, or any other indicia 506 as is known in the art. Specifically, any suitable indicia 506 as is known in the art can be included, such as, but not limited to, patterns, logos, emblems, images, symbols, designs, letters, words, characters, animals, advertisements, brands, etc., that may or may not be jewelry, storage, or brand related.

Figure 6:
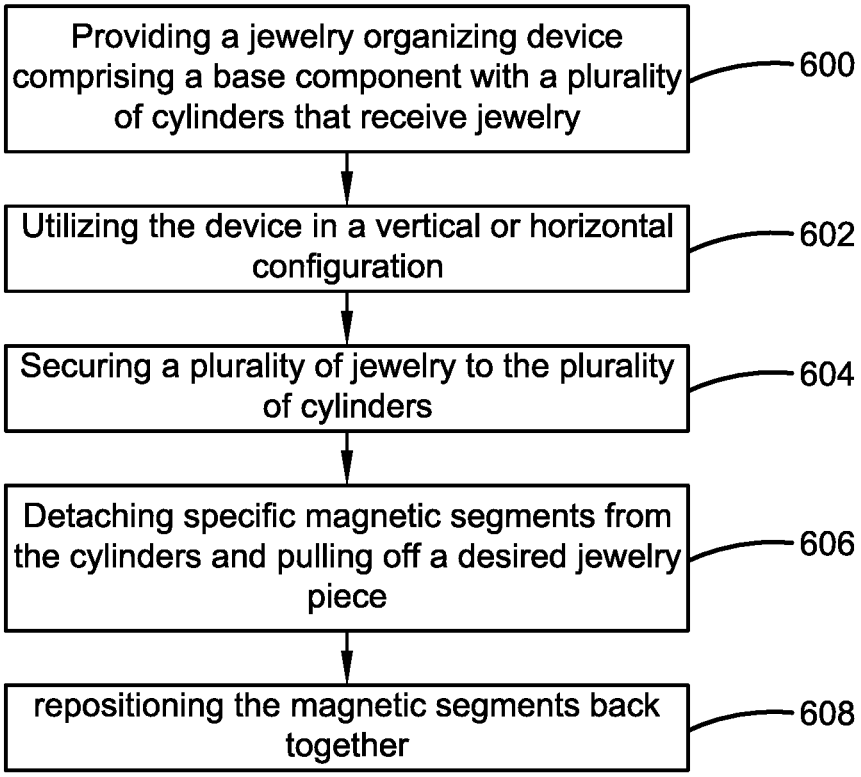
FIG. 6 illustrates a flowchart showing the method of organizing and protecting jewelry in accordance with the disclosed architecture.

FIG. 6 illustrates a flowchart of the method of organizing and protecting jewelry. The method includes the steps of at 600, providing a jewelry organizer device comprising a base component with a plurality of cylinders that receive jewelry. The method also comprises at 602, utilizing the jewelry organizer device in a vertical or a horizontal configuration. Further, the method comprises at 604, securing a plurality of jewelry to the plurality of cylinders. The method also comprises at 606, detaching specific magnetic segments from the cylinders and pulling off a desired jewelry piece. Finally, the method comprises at 608, repositioning the magnetic segments back together.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "jewelry organizer device", "organizer device", "jewelry device", and "device" are interchangeable and refer to the jewelry organizer device 100 of the present invention.

Notwithstanding the foregoing, the jewelry organizer device 100 of the present invention can be of any suitable size and configuration as is known in the art without affecting the overall concept of the invention, provided that it accomplishes the above-stated objectives. One of ordinary skill in the art will appreciate that the jewelry organizer device 100 as shown in FIGS. 1-6 are for illustrative purposes only, and that many other sizes and shapes of the jewelry organizer device 100 are well within the scope of the present disclosure. Although the dimensions of the jewelry organizer device 100 are important design parameters for user convenience, the jewelry organizer device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A jewelry organizer device that provides users with a detachable jewelry organizer that can be separated to access jewelry pieces, the jewelry organizer device comprising:
- a base component; and
- a plurality of cylinders;
- wherein the plurality of cylinders are secured to the base component;
- wherein the base component is a circular or rectangular shaped base and comprises a top and a bottom surface and opposing sides;
- wherein the plurality of cylinders are broken into a plurality of segments and secured together magnetically;
- wherein the plurality of segments can of any suitable number and of any suitable length;
- wherein the plurality of segments comprise a ferromagnetic or a magnetic element at each of their corresponding ends; and
- further wherein the plurality of cylinders can be separated to remove jewelry and repositioned back together.

2. The jewelry organizer device of claim 1, wherein the magnetic elements and the ferromagnetic elements of the corresponding ends of the plurality of segments provide secure removable attachment of the plurality of segments.

3. The jewelry organizer device of claim 2, wherein the magnetic or ferromagnetic elements of the plurality of segments, allow the plurality of segments to be pulled apart and secured back together.

4. The jewelry organizer device of claim 1 wherein the base component comprises a recessed drawer for storing additional jewelry.

5. The jewelry organizer device of claim 1, wherein the jewelry organizer device can be configured in a vertical or a horizontal configuration.

6. The jewelry organizer device of claim 5, wherein in the vertical configuration, at least one of the plurality of cylinders is secured in a vertical position in approximately a middle of the base component.

7. The jewelry organizer device of claim 5, wherein in the horizontal configuration, at least one of the plurality of cylinders is secured in a horizontal position, in a tiered configuration, suspended above the base component via plastic brackets.

8. The jewelry organizer device of claim 1, wherein the base component and the plurality of cylinders are covered in velvet.

9. A jewelry organizer device that provides users with a detachable jewelry organizer that can be separated to access jewelry pieces, the jewelry organizer device comprising:
- a base component; and
- a plurality of cylinders;
- wherein the plurality of cylinders are secured to the base component;
- wherein the plurality of cylinders are broken into a plurality of segments and secured together magnetically;
- wherein the plurality of segments can of any suitable number and of any suitable length;
- wherein the plurality of segments comprise a ferromagnetic or magnetic element at each of their corresponding ends;
- wherein the magnetic or ferromagnetic elements of the plurality of segments, allow the plurality of segments to be pulled apart and secured back together;

wherein the plurality of cylinders can be separated via the plurality of segments to remove jewelry and repositioned back together; and further wherein the jewelry organizer device can be configured in a vertical or a horizontal configuration.

10. The jewelry organizer device of claim 9 further comprising a plurality of indicia.

11. The jewelry organizer device of claim 9, wherein the base component comprises a recessed drawer for storing additional jewelry.

12. The jewelry organizer device of claim 9, wherein the base component and the plurality of cylinders are covered in velvet.

13. The jewelry organizer device of claim 9, wherein in the vertical configuration, at least one of the plurality of cylinders is secured in a vertical position in approximately a middle of the base component.

14. The jewelry organizer device of claim 9, wherein in the horizontal configuration, at least one of the plurality of cylinders is secured in a horizontal position, in a tiered configuration, suspended above the base component via plastic brackets.

15. The jewelry organizer device of claim 14, wherein in the horizontal configuration, the plurality of cylinders are arranged in varying heights on the base component.

* * * * *